US006865529B2

(12) United States Patent
Brandel et al.

(10) Patent No.: US 6,865,529 B2
(45) Date of Patent: Mar. 8, 2005

(54) METHOD OF ESTIMATING THE PITCH OF A SPEECH SIGNAL USING AN AVERAGE DISTANCE BETWEEN PEAKS, USE OF THE METHOD, AND A DEVICE ADAPTED THEREFOR

(75) Inventors: Cecilia Brandel, Lund (SE); Henrik Johannisson, Malmö (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 356 days.

(21) Appl. No.: 09/827,280

(22) Filed: Apr. 5, 2001

(65) Prior Publication Data

US 2001/0044714 A1 Nov. 22, 2001

Related U.S. Application Data

(60) Provisional application No. 60/197,785, filed on Apr. 14, 2000.

(30) Foreign Application Priority Data

Apr. 6, 2000 (EP) ..... 00610035

(51) Int. Cl.[7] ..... G10L 11/04; G10L 11/06; G10L 19/04

(52) U.S. Cl. ..... 704/207; 704/208; 704/219

(58) Field of Search ..... 704/207, 208, 704/214, 223, 233, 235, 243

(56) References Cited

U.S. PATENT DOCUMENTS

| | | | |
|---|---|---|---|
| 4,015,088 | A | 3/1977 | Dubnowski et al. |
| 4,081,605 | A | 3/1978 | Kitawaki et al. |
| 4,783,807 | A | 11/1988 | Marley |
| 5,121,428 | A | 6/1992 | Uchiyama et al. |
| 5,784,532 | A | 7/1998 | McDonough et al. |
| 5,970,441 | A | 10/1999 | Mekuria |
| 6,047,254 | A | 4/2000 | Ireton et al. |
| 6,377,915 | B1 | 4/2002 | Sasaki |
| 6,418,407 | B1 | 7/2002 | Huang et al. |
| 2001/0021906 | A1 | 9/2001 | Chihara |

FOREIGN PATENT DOCUMENTS

| | | |
|---|---|---|
| EP | 0 538 877 A2 | 4/1993 |
| EP | 0 712 116 A2 | 5/1996 |

OTHER PUBLICATIONS

Rabiner et al. "Digital Processing of Speech Signals," 1978, Prentice–Hall, pp. 446–450.*

Rabiner et al., Digital Processing of Speech Signals, 1978, pp. 141 and 144.*

(List continued on next page.)

*Primary Examiner*—Richemond Dorvil
*Assistant Examiner*—V. Paul Harper
(74) *Attorney, Agent, or Firm*—Jenkens & Gilchrist, P.C.

(57) ABSTRACT

A method of estimating the pitch of a speech signal comprises the steps of dividing the speech signal into segments, calculating for each segment a conformity function, and detecting peaks in the conformity function. The method further comprises the steps of estimating an average distance between said peaks, and using the estimated average distance as an estimate of the pitch. In this way a method less complex than prior art methods, and thus suitable for small digital signal processors, is provided. The method also avoids the pitch halving situation. When the method is based on the fact that the identified peaks in the conformity function show a periodic behavior and that the true pitch period actually corresponds to the distance between the peaks, a simpler algorithm is achieved which provides the true pitch period independent on the occurrence of pitch halving, pitch doubling, etc. A similar device is also provided.

15 Claims, 4 Drawing Sheets

OTHER PUBLICATIONS

Figure 1:
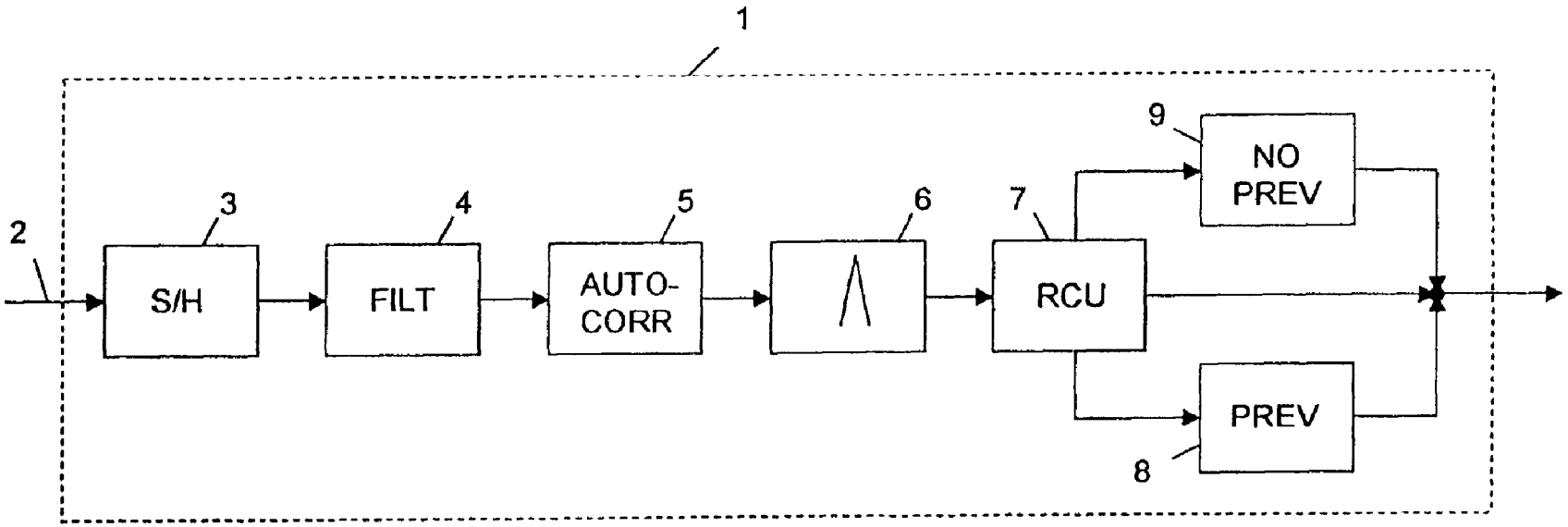

Ali Alkulaibi et al.; Fast 3–Level Binary Higher Order Statistics for Simultaneous Voiced/Unvoiced and Pitch Detection of a Speech Signal; Signal Processing; Elsvier; pp. 133–140, Dec. 1997.

Cecilia Brandel et al.; Speech Enhancement by Speech Rate Conversion; Department of Telecommunication and Signal Processing; pp. 34–57, Dec. 1999.

Linear Prediction Analysis; Tony Robinson; Speech Vision Robotics Group; 1 Page, Feb. 1998.

Quick Overview of Linear Predictive Coding (LPC) Analysis; 1 Page, Jan. 2000.

5.3 Linear Prediction Analysis; 3 Pages, May 24, 2000.

PLP–Perceptual Linear Predictive Analysis; 4 Pages, Oct. 6, 1998.

Linear Prediction; 2 Pages, Feb. 24, 1999.

Brandel, C. et al. "Speech Enhancement by Speech Rate Conversion," Department of Telecommunication and Signal Processing, , University of Karlskrona/Ronneby, Aug. 1999, pp. 35–40 and 55–57, paragraph 2.

Form ISA/210 PCT International Search Report as prepared on Jun. 13, 2001 for PCT/EP 01/03495 (4 pgs).

Quélavoine, R., European Search Report, Application No. EP 00 61 0035, Sep. 5, 2000, pp. 1–3.

Chilton, E. et al., "The Spectral Autocorrelation Applied to the Linear Prediction Residual of Speech for Robust Pitch Detection," ICASSP 88: 1988 International Conference on Acoustics, Speech, and Signal Processing, Apr. 11–14, 1988, New York, NY, IEEE, USA, pp. 358–361, vol. 1.

Chilton, E. et al., "Performance Comparison of Five Pitch Determination Algorithms on the Linear Prediction Residual of Speech," European Conference on Speech Technology, GB, Edinburgh, CEP Consultants, vol. CONF. 1, Sep. 1, 1987, pp. 403–406.

Krubsack, D. et al., "An Autocorrelation Pitch Detector and Voicing Decision with Confidence Measures Developed for Noise–Corrupted Speech," IEEE Transactions on Signal Processing, vol. 39, No. 2, Feb. 1991.

* cited by examiner

METHOD OF ESTIMATING THE PITCH OF A SPEECH SIGNAL USING AN AVERAGE DISTANCE BETWEEN PEAKS, USE OF THE METHOD, AND A DEVICE ADAPTED THEREFOR

CROSS REFERENCES TO RELATED APPLICATIONS

This application for patent claims the benefit of priority from, and hereby incorporates by reference the entire disclosure of, now abandoned U.S. Provisional Application for Patent Ser. No. 60/197,785, filed Apr. 14, 2000.

The invention relates to a method of estimating the pitch of a speech signal, said method being of the type where the speech signal is divided into segments, a conformity function for the signal is calculated for each segment, and peaks in the conformity function are detected. The invention also relates to the use of the method in a mobile telephone. Further, the invention relates to a device adapted to estimate the pitch of a speech signal.

In many speech processing systems it is desirable to know the pitch period of the speech. As an example, several speech enhancement algorithms are dependent on having a correct estimate of the pitch period. One field of application where speech processing algorithms are widely used is in mobile telephones.

A well known way of estimating the pitch period is to use the autocorrelation function, or a similar conformity function, on the speech signal. An example of such a method is described in the article D. A. Krubsack, R. J. Niederjohn, "An Autocorrelation Pitch Detector and Voicing Decision with Confidence Measures Developed for Noise-Corrupted Speech", IEEE Transactions on Signal Processing, vol. 39, no. 2, pp. 319–329, February 1991. The speech signal is divided into segments of 51.2 ms, and the standard short-time autocorrelation function is calculated for each successive speech segment. A peak picking algorithm is applied to the autocorrelation function of each segment. This algorithm starts by choosing the maximum peak (largest value) in the pitch range of 50 to 333 Hz. The period corresponding to this peak is selected as an estimate of the pitch period.

However, such a basic pitch estimation algorithm is not sufficient. In some cases pitch doubling or pitch halving can occur, i.e. the highest peak appears at either half the pitch period or twice the pitch period. The highest peak may also appear at another multiple of the true pitch period. In these cases a simple selection of the maximum peak will provide a wrong estimate of the pitch period.

The above-mentioned article also discloses a method of improving the algorithm in these situations. The algorithm checks for peaks at one-half, one-third, one-fourth, one-fifth, and one-sixth of the first estimate of the pitch period. If the half of the first estimate is within the pitch range, the maximum value of the autocorrelation within an interval around this half value is located. If this new peak is greater than one-half of the old peak, the new corresponding value replaces the old estimate, thus providing a new estimate which is presumably corrected for the possibility of the pitch period doubling error. This test is performed again to check for double doubling errors (fourfold errors). If this most recent test fails, a similar test is performed for tripling errors of this new estimate. This test checks for pitch period errors of sixfold. If the original test failed, the original estimate is tested (in a similar manner) for tripling errors and errors of fivefold. The final value is used to calculate the pitch estimate.

However, this known algorithm is rather complex and requires a high number of calculations, and these drawbacks make it less usable in real time environments on small digital signal processors as they are used in mobile telephones and similar devices. Further, the algorithm only checks for pitch doubling, pitch tripling, etc., while pitch halving is not considered. Actually, if a peak is present at the half of the true pitch period, the S algorithm would (wrongly) choose that peak as the estimate of the pitch period.

Thus, it is an object of the invention to provide a method of the above-mentioned type which is less complex than the prior art methods, such that the method is suitable for small digital signal processors. Further, the method should also avoid the pitch halving situation.

According to the invention, this object is achieved in that the method comprises the steps of estimating an average distance between the detected peaks, and using this estimate of the average distance as an estimate of the pitch.

When the method is based on the fact that the identified peaks in the conformity function show a periodic behaviour and that the true pitch period actually corresponds to the distance between the peaks, a simpler algorithm is achieved which provides the true pitch period independent on the occurrence of pitch halving, pitch doubling, etc.

When the method further comprises the steps of sampling the speech signal to obtain a series of samples, and performing the division into segments such that each segment has a fixed number of consecutive samples, an even less complex method is achieved because only a finite number of samples has to be considered.

When the method further comprises the steps of estimating a set of filter parameters using linear predictive analysis (LPA), providing a modified signal by filtering the speech signal through a filter based on this estimated set of filter parameters, and calculating the conformity function of the modified signal, much of the smearing of the original speech signal is removed and thus the possibility of clearer peaks in the conformity function is improved, which results in a more precise estimation of the pitch period.

An expedient embodiment of the invention is achieved when the conformity function is calculated as an autocorrelation function. However, it should be noted that also other conformity functions may be utilized, such as e.g. a cross correlation between the original speech signal and the above-mentioned modified signal.

An improved method is achieved when the method further comprises the steps of calculating, for each peak in the conformity function, the difference between the position of the peak and the estimate of the average distance, and providing an improved estimate of the pitch by selecting as the improved estimate the position of the peak having the smallest value of said difference. In this way the position of an actual peak is used as the estimate and it is still assured that the correct peak is used. If, in this case, the peak having the smallest value of the difference is represented by a number of samples, the best estimate is achieved when the sample having the maximum amplitude of the conformity function is selected as the improved estimate of the pitch.

In an expedient embodiment of the invention the method is used in a mobile telephone which is a typical example of a device having only limited computational resources.

As mentioned, the invention further relates to a device adapted to estimate the pitch of a speech signal. The device comprises means for dividing the speech signal into segments, means for calculating for each segment a conformity function for the signal, and means for detecting peaks in the conformity function. When the device is further adapted to estimate an average distance between said peaks, and to use the estimate of said average distance as an estimate of the pitch, a device less complex than prior art devices is achieved, which also avoids the pitch halving situation.

When the device further comprises means for sampling the speech signal to obtain a series of samples, and means for performing said division into segments such that each segment has a fixed number of consecutive samples, an even less complex device is achieved because only a finite number of samples has to be considered.

When the device further comprises means for estimating a set of filter parameters using linear predictive analysis (LPA), means for providing a modified signal by filtering the speech signal through a filter based on this estimated set of filter parameters, and means for calculating the conformity function of the modified signal, much of the smearing of the original speech signal is removed and thus the possibility of clearer peaks in the conformity function is improved, which results in a more precise estimation of the pitch period.

An expedient embodiment of the invention is achieved when the conformity function is an autocorrelation function. However, it should be noted that also other conformity functions may be utilized, such as e.g. a cross correlation between the original speech signal and the abovementioned modified signal.

An improved device is achieved when the device further comprises means for calculating, for each peak in the conformity function, the difference between the position of the peak and the estimate of the average distance, and means for providing an improved estimate of the pitch by selecting as the improved estimate the position of the peak having the smallest value of said difference. In this way the position of an actual peak is used as the estimate and it is still assured that the correct peak is used. If, in this case, the peak having the smallest value of the difference is represented by a number of samples, the best estimate is achieved when the sample having the maximum amplitude of the conformity function is selected as the improved estimate of the pitch.

In an expedient embodiment of the invention, the device is a mobile telephone, which is a typical example of a device having only limited computational resources.

In another embodiment the device is an integrated circuit which can be used in different types of equipment.

Figure 2:
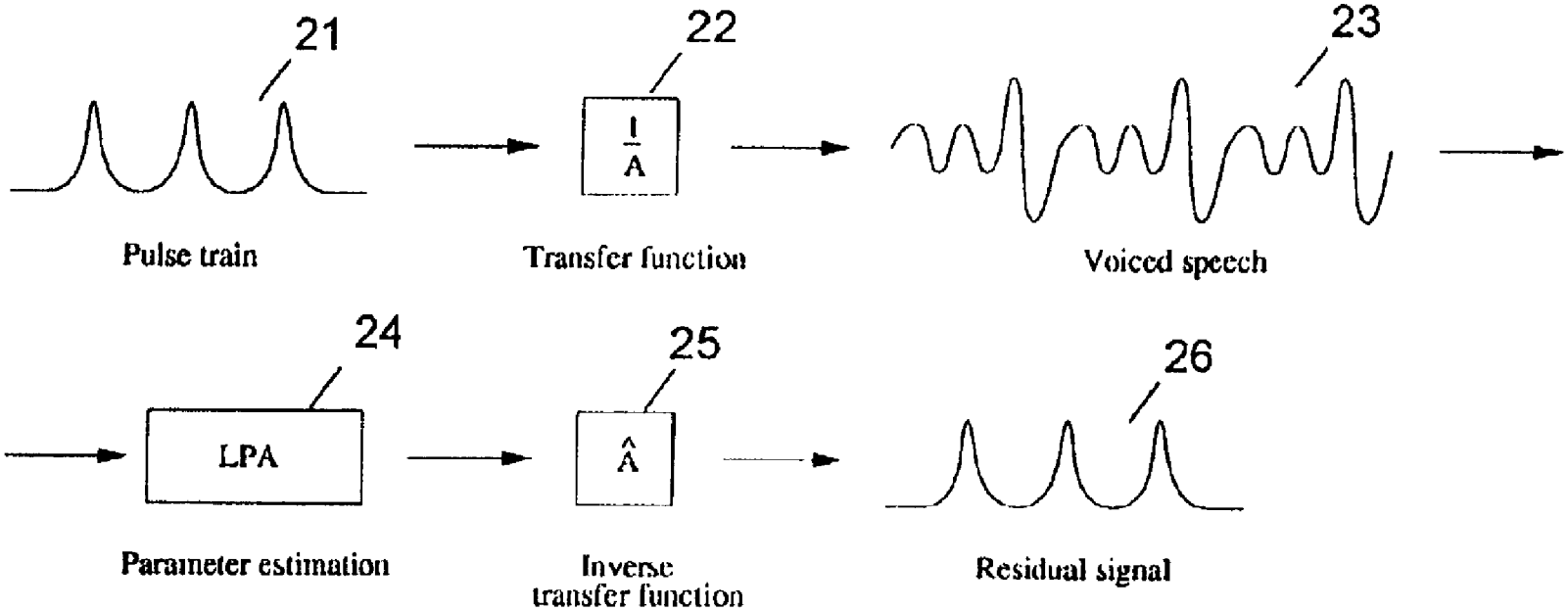
Figure 3A:
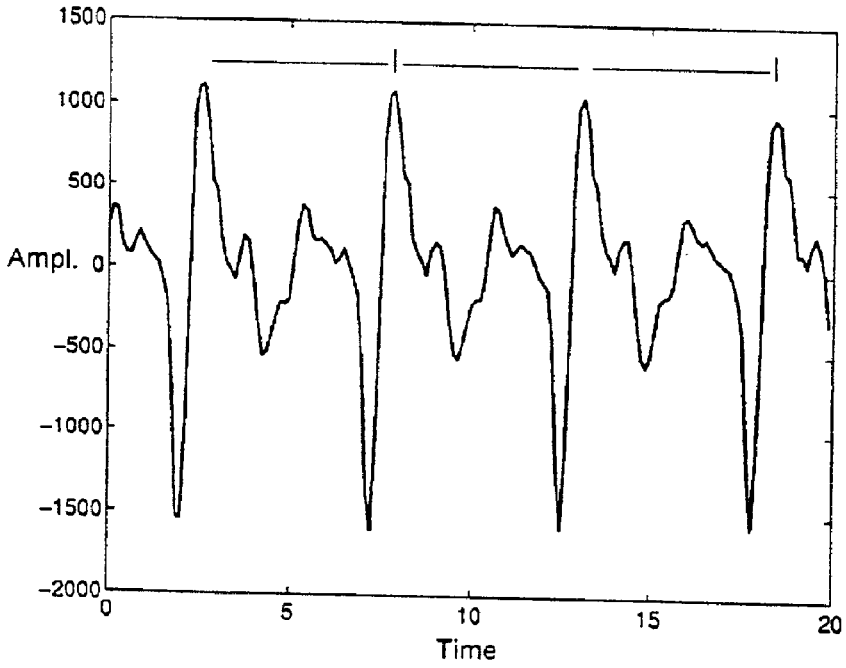
Figure 3B:
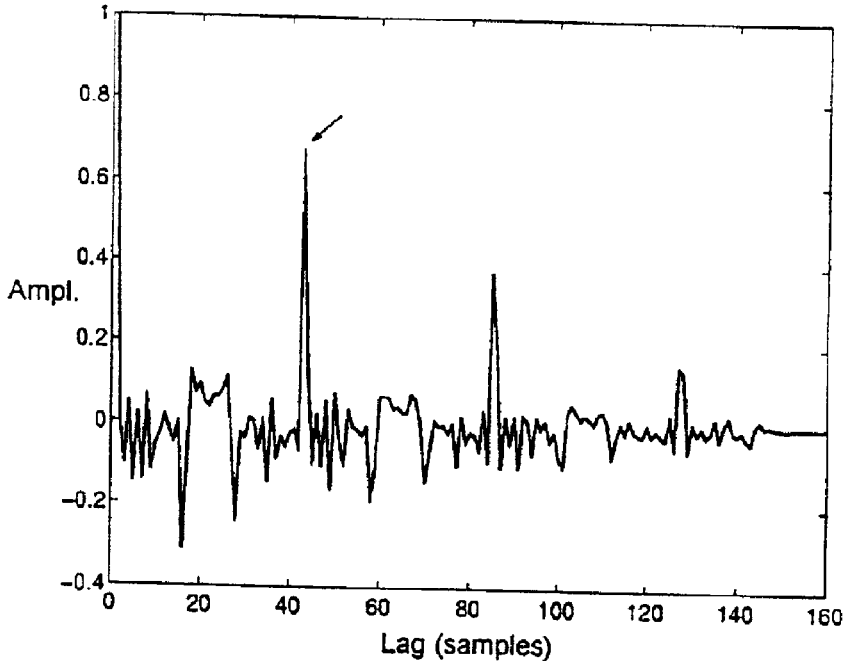
Figure 4:
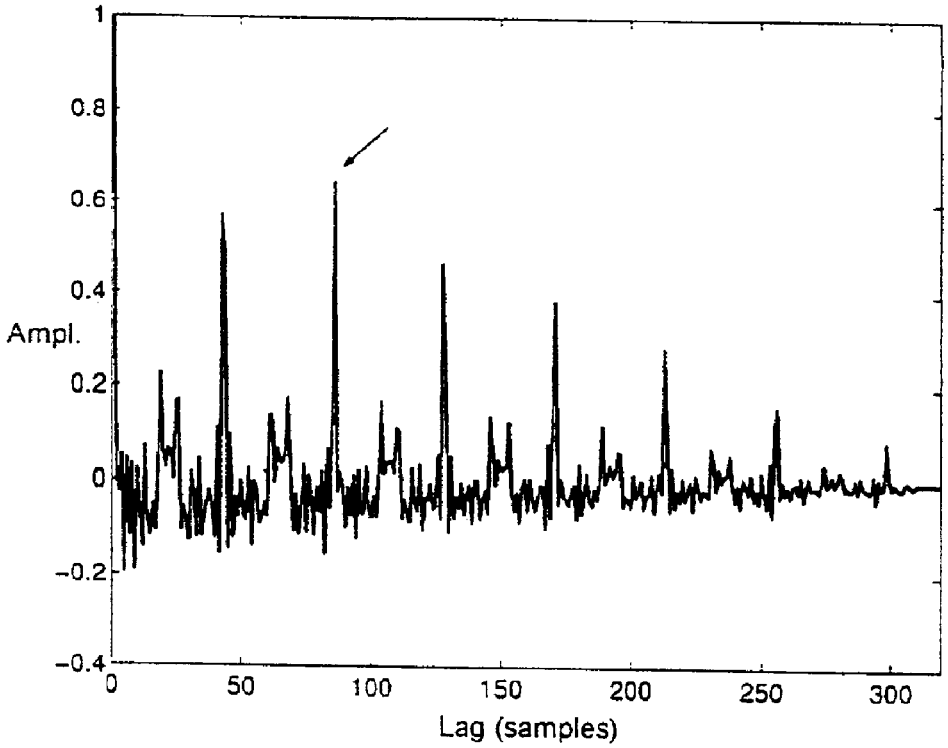
Figure 5:
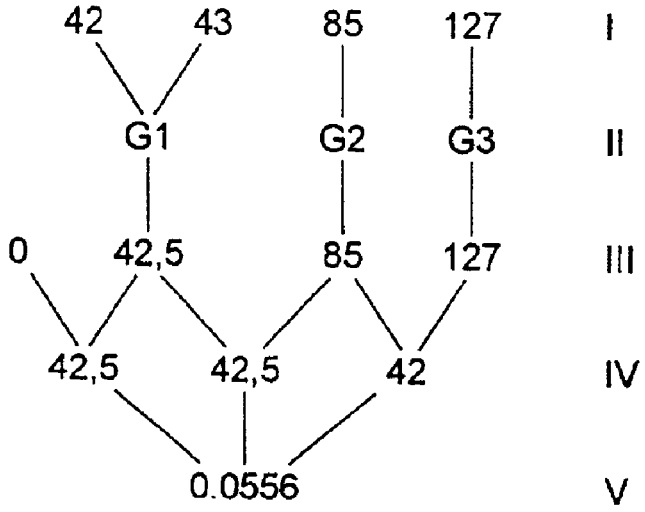

The invention will now be described more fully below with reference to the drawing, in which FIG. 1 shows a block diagram of a pitch detector according to the invention, FIG. 2 shows the generation of a residual signal, FIG. 3*a* shows a 20 ms segment of a voiced speech signal, FIG. 3*b* shows the autocorrelation function of a residual signal corresponding to the segment of FIG. 3*a*, FIG. 4 shows an example of an autocorrelation function where pitch doubling could arise, and FIG. 5 shows an example of the calculation of the distance between peaks in an autocorrelation function.

FIG. 1 shows a block diagram of an example of a pitch detector 1 according to the invention. A speech signal 2 is sampled with a sampling rate of 8 kHz in the sampling circuit 3 and the samples are divided into segments or frames of 160 consecutive samples. Thus, each segment corresponds to 20 ms of the speech signal. This is the sampling and segmentation normally used for the speech processing in a standard mobile telephone.

Each segment of 160 samples is then processed in a filter 4, which will be described in further detail below.

First, however, the nature of speech signals will be mentioned briefly. In a classical approach a speech signal is modelled as an output of a slowly time-varying linear filter. The filter is either excited by a quasi-periodic sequence of pulses or random noise depending on whether a voiced or an unvoiced sound is to be created. The pulse train which creates voiced sounds is produced by pressing air out of the lungs through the vibrating vocal cords. The period of time between the pulses is called the pitch period and is of great importance for the singularity of the speech. On the other hand, unvoiced sounds are generated by forming a constriction in the vocal tract and produce turbulence by forcing air through the constriction at a high velocity. This description deals with the detection of the pitch period of voiced sounds and thus, unvoiced sounds will not be further considered.

As speech is a varying signal also the filter has to be time-varying. However, the properties of a speech signal change relatively slowly with time. It is reasonable to believe that the general properties of speech remain fixed for periods of 10–20 ms. This has led to the basic principle that if short segments of the speech signal are considered, each segment can effectively be modelled as having been generated by exciting a linear time-invariant system during that period of time. The effect of the filter can be seen as caused by the vocal tract, the tongue, the mouth and the lips.

As mentioned, voiced speech can be interpreted as the output signal from a linear filter driven by an excitation signal. This is shown in the upper part of FIG. 2 in which the pulse train 21 is processed by the filter 22 to produce the voiced speech signal 23. A good signal for the detection of the pitch period is obtained if the excitation signal can be extracted from the speech. By estimating the filter parameters A in the block 24 and then filtering the speech through an inverse filter 25 based on the estimated filter parameters, a signal 26 similar to the excitation signal can be obtained. This signal is called the residual signal. This process is shown in the lower part of FIG. 2. The blocks 24 and 25 are included in the filter 4 in FIG. 1.

The estimation of the filter parameters is based on an all-pole modelling which is performed by means of the method called linear predictive analysis (LPA). The name comes from the fact that the method is equivalent with linear prediction. This method is well known in the art and will not be described in further detail here.

The estimation of the pitch is based on the autocorrelation of the residual signal, which is obtained as described above. Thus, the output signal from the filter 4 is taken to an autocorrelation calculation unit 5. FIG. 3*a* shows an example of a 20 ms segment of a voiced speech signal and FIG. 3*b* the corresponding autocorrelation function of the residual signal. It will be seen from FIG. 3*a* that the actual pitch period is about 5.25 ms corresponding to 42 samples, and thus the pitch estimation should end up with this value.

The next step in the estimation of the pitch is to apply a peak picking algorithm to the autocorrelation function provided by the unit 5. This is done in the peak detector 6 which identifies the maximum peak (i.e. the largest value) in the autocorrelation function. The index value, i.e. the sample number or the lag, of the maximum peak is then used as a preliminary estimate of the pitch period. In the case shown in FIG. 3*b* it will be seen that the maximum peak is actually located at a lag of 42 samples. The search of the maximum peak is only performed in the range where a pitch period is likely to be located. In this case the range is set to 60–333 Hz.

However, this basic pitch estimation algorithm is not always sufficient. In some cases pitch doubling or halving may occur, i.e. due to distortion the peak in the autocorrelation function corresponding to the true pitch period is not the highest peak, but instead the highest peak appears at either half the pitch period or twice the pitch period. The highest peak could also appear at other multiples of the actual pitch period (pitch tripling, etc.) although this occurs relatively rarely. A typical example where pitch doubling would arise is shown in FIG. 4 which again shows the autocorrelation function of the residual signal. Here too, the correct pitch period would be around 42 samples, but the peak at twice the pitch period, i.e. around 84 samples, is actually higher than the one at 42 samples. The basic pitch estimation algorithm would therefore estimate the pitch period to 84 samples and pitch doubling would thus occur. It will also be seen that two smaller peaks are located around half the pitch period, and in some cases one of these could be higher than the correct peak and pitch halving would occur.

To avoid the problem of pitch doubling and halving the pitch detection algorithm is therefore improved as described below.

After the preliminary pitch estimate has been determined, it is checked in the risk check unit 7 whether there is any risk of pitch halving or pitch doubling. All peaks with a peak value higher than 75% of the maximum peak are detected and the further processing depends on the result of this detection. If only one peak is detected, i.e. the original maximum peak, there is no need to perform a process to avoid pitch doubling and pitch halving. In this situation the preliminary pitch estimate is used as the final pitch estimate. If, however, more than one peak is detected, there is a risk of pitch doubling or pitch halving, and a further algorithm must be performed to ensure that the correct peak is selected as the pitch estimate.

Two different solutions to such an algorithm will be described. One solution, which is performed in the unit 8, is used when pitch estimates are available from a number of previous segments, while the other solution, which is performed in the unit 9, is used when such estimates are not available, which will be the case in the beginning of a speech signal. The latter solution is described first.

In cases where no previously estimated pitch periods are available, the procedure to avoid pitch doubling and pitch halving is based on the fact that the identified peaks show a periodic behaviour. Actually it can be said that the pitch period simply corresponds to the distance between the peaks. Index values, i.e. the lag, of the detected peaks are sorted into groups depending on how close to each other the indexes are. In many cases a peak can be represented by more than one index, i.e. more than one sample, resulting in several indexes around a peak being detected. Indexes with a distance of less than e.g. five samples are sorted into the same group.

For each group an average is calculated and then differences (distances) between the averaged indexes are calculated. The difference towards zero is also calculated since the first peak may be the actual pitch period. If the detected peaks represent the periodic behaviour of the speech signal in the current segment the differences between the groups ought to be about the same.

Therefore, if the variance of the differences between the groups is below a given threshold, e.g. 10, the average of the differences, i.e. the average distance, is assumed to be approximately the pitch period and is thus used as a secondary estimate of the pitch period. The variance threshold can be set from watching probable differences between mean values and their variance.

An example of this procedure is shown in FIG. 5 in which level I shows the received indexes of the highest peaks. In level II the indexes are sorted into groups and the mean values of the groups are calculated in level III. The differences between mean values are shown in level IV and finally, the variance is calculated in level V.

The average distance may be used directly as the pitch estimate, or the method can be improved by subtracting the average distance from each of the average indexes representing different groups (level III). The group in which the smallest result of this subtraction, i.e. the group closest to the average distance, is found is selected as the pitch estimate.

If, however, the variance is above the threshold, it means that the distances between peaks are too different to represent the periodic behaviour of the signal. In this case the method cannot be used and the preliminary pitch estimate is maintained as the best estimate.

When this method has been used for a number of consecutive segments, and if the pitch estimates for these segments are stored in a memory, these previous estimates may be used in a different method of avoiding pitch doubling and pitch halving. This method is described below.

First, an average of the previous pitch estimates from e.g. the last 15 segments is calculated. This value is then subtracted from the index values where the highest peaks in the autocorrelation function of the residual signal are located, which means that the differences between the index values of the highest peaks and the average of the previously detected pitch periods are calculated. Since the pitch period for a given person is relatively constant over time, a small difference between the correct pitch period of the current segment and the average of the previous pitch estimates is expected. Therefore, those values in the resulting vector of subtraction results that are below a given threshold, e.g. 10, are selected. The use of the threshold is due to the fact that the pitch period may actually vary slightly while a person is talking, and therefore such a difference has to be accepted. The actual threshold can be set from watching probable examples.

If only one difference is below the threshold the corresponding index value or lag is selected as the estimate of the pitch period. If more than one difference is below the threshold, the one with the highest amplitude in the autocorrelation of the residual signal is selected. If there are no differences below the threshold, this indicates that the pitch has changed drastically, as it may e.g. be the case when switching speakers. In such a case the preliminary pitch estimate is maintained as the best estimate.

This method utilizing previous estimates is considerably less complex than the other one based on the distance between the peaks, and therefore it should be used as soon as there are sufficient previous estimates in order to reduce the needed amount of computational resources.

As mentioned above, one example of equipment in which the invention can be implemented is a mobile telephone. The algorithm may also be implemented in an integrated circuit which may then be used in other types of equipment.

Although a preferred embodiment of the present invention has been described and shown, the invention is not restricted to it, but may also be embodied in other ways within the scope of the subject-matter defined in the following claims.

Thus, the autocorrelation function may be calculated directly of the speech signal instead of the residual signal, or other conformity functions may be used instead of the autocorrelation function. As an example, a cross correlation could be calculated between the speech signal and the residual signal. It is also possible to repeat the autocorrelation, i.e. to calculate the autocorrelation of the result of the first autocorrelation, before detecting peaks.

Further, different sampling rates and sizes of the segments may be used.

What is claimed is:

1. A method of estimating a pitch of a speech signal, said method comprising:

dividing the speech signal into segments;

calculating for each segment a conformity function for the signal;

detecting peaks in the conformity function;

responsive to at least three peaks having been detected:

determining, for each two successive peaks of the at least three detected peaks, of a distance therebetween;

estimating an average successive-peak distance; and using the estimate of said average successive-peak distance as an estimate of the pitch.

2. The method according to claim 1, further comprising:

sampling the speech signal to obtain a series of samples; and performing said division into segments such that each segment has a fixed number of consecutive samples.

3. The method according to claim 1 further comprising:

estimating a set of filter parameters using linear predictive analysis (LPA);

providing a modified signal by filtering the speech signal through a filter based on said estimated set of filter parameters; and calculating said conformity function of the modified signal.

4. The method according to claim 1, wherein said conformity function is calculated as an autocorrelation function.

5. The method according to claim 1 further comprising:

calculating, for each of the at least three peaks, the difference between the position of the peak and the estimate of said average successive-peak distance; and providing an improved estimate of the pitch by selecting as the improved estimate the position of the peak having the smallest value of said difference.

6. The method according to claim 5 further comprising:

selecting, if the peak having the smallest value of said difference is represented by a number of samples, the sample having the maximum amplitude of said conformity function as said improved estimate of the pitch.

7. The method according to claim 1, wherein said method is used in a mobile telephone.

8. A device adapted to estimate a pitch of a speech signal, said device comprising:

means for dividing the speech signal into segments;

means for calculating for each segment a conformity function for the signal;

means for detecting peaks in the conformity function;

means for determining, responsive to at least three peaks having been detected, for each two successive peaks of the at least three detected peaks, of a distance therebetween;

means for estimating an average successive-peak distance; and means for using the estimate of said average successive-peak distance as an estimate of the pitch.

9. The device according to claim 8 further comprising:

means for sampling the speech signal to obtain a series of samples; and means for performing said division into segments such that each segment has a fixed number of consecutive samples.

10. The device according to claim 8 further comprising:

means for estimating a set of filter parameters using linear predictive analysis (LPA);

means for providing a modified signal by filtering the speech signal through a filter based on said estimated set of filter parameters; and means for calculating said conformity function of the modified signal.

11. The device according to claim 8, wherein said conformity function is an autocorrelation function.

12. The device according to claim 8 further comprising:

means for calculating, for each of the at least three peaks, the difference between the position of the peak and the estimate of said average successive-peak distance; and means for providing an improved estimate of the pitch by selecting as the improved estimate the position of the peak having the smallest value of said difference.

13. The device according to claim 12, wherein the device is further adapted to select, if the peak having the smallest value of said difference is represented by a number of samples, the sample having the maximum amplitude of said conformity function as said improved estimate of the pitch.

14. The device according to claim 8, wherein the device is a mobile telephone.

15. The device according to claim 8, wherein the device is an integrated circuit.

* * * * *

UNITED STATES PATENT AND TRADEMARK OFFICE

CERTIFICATE OF CORRECTION

PATENT NO. : 6,865,529 B2
APPLICATION NO. : 09/827280
DATED : March 8, 2005
INVENTOR(S) : Cecilia Brandel et al.

It is certified that error appears in the above-identified patent and that said Letters Patent is hereby corrected as shown below:

On the Title Page, Field (57), under "ABSTRACT", in Column 2, Line 1, after "signal" insert -- (2) --.

In Column 1, Line 13, insert -- Field of the Invention -- before "The Invention" as heading.

In Column 2, Line 8, after "the" delete "S".

In Column 8, Line 37, in Claim 12, insert -- of -- before "the".

Signed and Sealed this

Thirtieth Day of October, 2007

JON W. DUDAS
*Director of the United States Patent and Trademark Office*